United States Patent [19]

Puff et al.

[11] Patent Number: 4,627,387

[45] Date of Patent: Dec. 9, 1986

[54] FLUIDIZED-BED APPARATUS WITH A HEAT EXCHANGER AND AN ADDITIONAL-AIR BLOWING NETWORK

[75] Inventors: Roger M. Puff, Lens; Jacques P. Dreuilhe, L'Isle Adam, both of France

[73] Assignees: Charbonnages de France; Framatome; Institut Français du Petrole, all of Paris, France

[21] Appl. No.: 782,556

[22] Filed: Oct. 1, 1985

[30] Foreign Application Priority Data

Oct. 2, 1984 [FR] France ..... 84 15105

[51] Int. Cl.[4] ..... F22B 1/00

[52] U.S. Cl. ..... 122/4 D; 165/104.16

[58] Field of Search ..... 122/4 D; 165/104.16

[56] References Cited

U.S. PATENT DOCUMENTS

| | | | |
|---|---|---|---|
| 4,232,633 | 11/1980 | Chambert . | |
| 4,335,785 | 6/1982 | Hodges et al. | 122/4 D |
| 4,492,184 | 1/1985 | Norton et al. | 122/4 D |

FOREIGN PATENT DOCUMENTS

| | | |
|---|---|---|
| 0032798 | 5/1981 | European Pat. Off. . |
| 2819996 | 4/1981 | Fed. Rep. of Germany . |
| 2952091 | 7/1981 | Fed. Rep. of Germany . |
| 3027517 | 8/1982 | Fed. Rep. of Germany . |
| 2034868 | 7/1981 | United Kingdom . |

OTHER PUBLICATIONS

English Abstracts of German Patents DE No. 2952091 and DE No. 3027517.

*Primary Examiner*—Edward G. Favors

*Attorney, Agent, or Firm*—Cushman, Darby & Cushman

[57] ABSTRACT

A fluidized-bed apparatus with a heat exchanger and an additional-air blowing network. The heat exchanger comprises upright tubes extending from a lower header which is slightly inclined to the horizontal, to an upper header. The lower header consists of an internal duct which is connected to the tubes and an external duct which has blowing nozzles and is connected to an additional-air supply line in order to alter the height of the bed in which the upright tubes are immersed.

10 Claims, 4 Drawing Figures

FLUIDIZED-BED APPARATUS WITH A HEAT EXCHANGER AND AN ADDITIONAL-AIR BLOWING NETWORK

BACKGROUND TO THE INVENTION

The invention relates to a fluidised-bed apparatus, for example a boiler for the combustion of coal in the form of fluidisable particles in a fluidised bed, in which there is a tube arrangement forming part of a heat exchanger with the fluidised bed and an additional air or gas blowing network which is independent of the fluidisation air or gas network.

Fluidised beds with heat exchangers are already known, in particular in the field of boilers. A known exchanger comprises at least two headers, one at the fluid inlet and one at the fluid outlet, between which the heat-exchange tubes are located. Various arrangements of these exchange tubes between the headers have been proposed. Horizontal tubes have a larger area of contact with the fluidised bed than vertical tubes, but they are highly susceptible to erosion and corrosion. Vertical tubes withstand erosion better than horizontal tubes and inclined tubes; they require a larger number of tubes, but they also possess the advantage of providing a greater degree of flexibility as regards operation since, by varying the height of the fluidised bed, it is possible to alter significantly the depth of immersion of these tubes in the fluidised bed. A particularly convenient method for varying the height of the fluidised bed consists in regulating its expansion by changing the fluidisation speed by means of an additional-air blowing network which is independent of the main fluidisation-air network.

The main object of the invention is to provide, in a simple manner, a fluidised-bed apparatus which has a heat exchanger with vertical tubes and an additional-air blowing network and with which it is possible to obtain all of the abovementioned advantages, in particular flexibility in operation and a low degree of erosion or corrosion of the tubes.

SUMMARY OF THE INVENTION

The present invention provides a fluidised-bed apparatus with at least one heat exchanger having a lower header which is slightly inclined to the horizontal and is situated in the fluidised bed during operation, an upper header, and a plurality of upright tubes which extend between the lower header and the upper header, the lower header consisting of an internal duct, which is connected to a circuit for the heat-exchange fluid and from which the upright tubes extend, and an external duct, which is connected to an additional blowing gas supply line and is provided with blowing nozzles.

In the fluidised-bed apparatus of the present invention, the heat exchanger has upright tubes extending between the lower header and the upper header which are slightly inclined in relation to the horizontal and an additional-air blowing network owing to the fact that the lower header of the heat exchanger is of the type with a double casing consisting of an internal duct from which the upright tubes for circulating the exchanger fluid extend and an external duct which, together with the internal duct, defines an intermediate space which is connected to an additional-air blowing network, the external duct being provided with air outlet nozzles.

The external duct may be arranged concentrically in relation to the internal duct, which defines a cylindrical annular space between the external and internal ducts. The external duct may also be eccentric in relation to the internal duct and may be connected to the latter in a tangential or intersecting manner, so that the intermediate space has, when viewed in cross-section, the profile of a crescent.

According to a preferred embodiment of the invention, the external duct extends outside the walls of the fluidised-bed apparatus and is connected, at its upper end, to the additional-air inlet, preferably at the lowest point of its cross-section, while its lower end is provided with a bleed valve which is intended to allow the removal, when required, of the ash which may have penetrated into the intermediate space.

DESCRIPTION OF THE PREFERRED EMBODIMENTS

Figure 1:
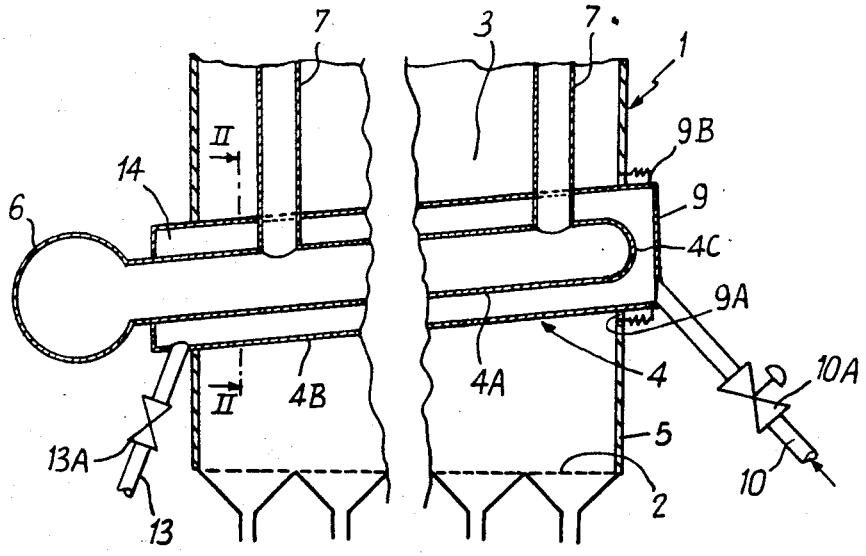
FIG. 1 is a diagrammatic view, in longitudinal section, of a lower header with a double casing, forming part of a fluidised-bed apparatus according to the invention.

FIG. 1 shows only part of the bottom zone of a coal-burning boiler 1 in which coal is burned in a fluidised bed above a grate 2 through which the main fluidisation air is blown. The grate 2 may be of any type, as the invention is independent of the type of grate 2. At least one heat exchanger is installed inside the furnace 3 of the boiler and comprises a lower header 4 which is arranged in the fluidised bed in the vicinity of the grate 2 and is inclined at a slight angle (7° for example) to the horizontal. At its lower end which is located outside the wall 5 of the furnace 3, the header 4 is connected to a water supply circuit 6. Vertical heat-exchanging tubes 7 extend from the lower header 4 to an upper header (not shown in FIG. 1) for discharging the steam which is produced from the water when it is heated in the heat exchanger.

Figure 2:
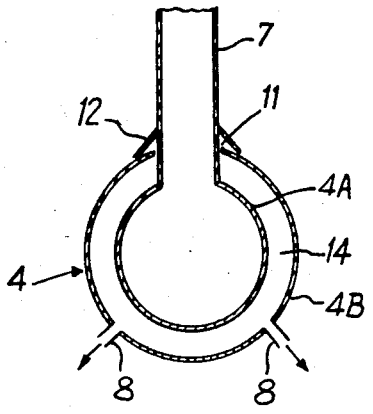
FIG. 2 is a cross-sectional view along the line II—II of FIG. 1 showing that the external duct and the internal duct are arranged concentrically.

The lower header 4 comprises an internal duct 4A which is connected to the circuit 6 and an external duct 4B which concentrically surrounds the internal duct 4A, as is shown in FIG. 2, along the entire width of the furnace 3 and preferably beyond the walls of the furnace 3. In the direction of its length, the external duct 4B is provided, at the bottom, with downward pointing nozzles 8 arranged at suitable intervals and preferably located on two generatrices diverging from the vertical at an angle of 45°, as can be seen in FIG. 2.

At its upper end 9 which is located outside the wall 5 of the boiler 1, the external duct 4B is connected, at the lowest point of its cross-section, outside the boiler 1, to an additional-air supply line 10 which is provided with a flow regulating valve 10A. The upper end 9 of the external duct 4B freely passes through the wall 5 of the boiler 1 via a larger opening 9A and is joined to the walls by means of a flexible expansion joint 9B which ensures a leak-tight closure. The internal duct 4A has at its upper end a bottom 4C which is inside the external duct 4B.

The external duct 4B with its nozzles 8 forms part of the additional-air blowing network which can be used to alter the immersion depth of the tubes 7. At the same time, it enables the internal duct 4A of the water/steam network to be protected. Moreover, since it plays no part in the heat-exchange process, it may be protected against erosion by means of a suitable treatment or coating.

The vertical tubes 7 each pass through a respective opening 11 in the external duct 4B which is larger than the external diameter of the respective vertical tubes 7, thereby allowing the vertical tubes 7 to expand. A conical cover-piece 12 which is welded to a respective one of the tubes 7 covers the respective opening 11 so as to prevent ash entering through the opening 11.

By way of an additional precaution, the lower end of the external duct 4B is provided, at the lowest points in its cross-section and outside the wall 5 of the boiler 1, with a bleed pipe 13 which is provided with a bleed valve 13A. It is thus possible to remove, when required, the ash which has accidentally penetrated into the intermediate space 14 which is situated between the ducts 4A and 4B, by using the additional air which is provided by the supply line 10, without the need for another pressurised-air circuit.

Figure 3:
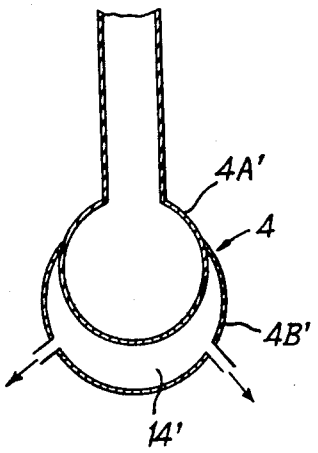
FIG. 3 is a sectional view, similar to FIG. 2, showing an alternative embodiment of the invention in which the external duct and the internal duct intersect.

It can be seen in FIG. 2 that, when these ducts 4A and 4B are coaxial, the intermediate space 14 is annular and cylindrical. FIG. 3 shows an alternative embodiment of the invention according to which the external duct 4B' is eccentric in relation to the internal duct 4A' when viewed in cross-section, the profiles intersect and the intermediate space 14' has the shape of a crescent. The intermediate space 14' is widest below the lower generatrix of the internal duct 4A'. The internal duct 4A' is therefore protected more towards the bottom whereas, in the example shown in FIG. 2, it is protected equally in all directions.

The invention can also be used in apparatus where the tubes 7 are not vertical, but are upright and more or less inclined.

Figure 4:
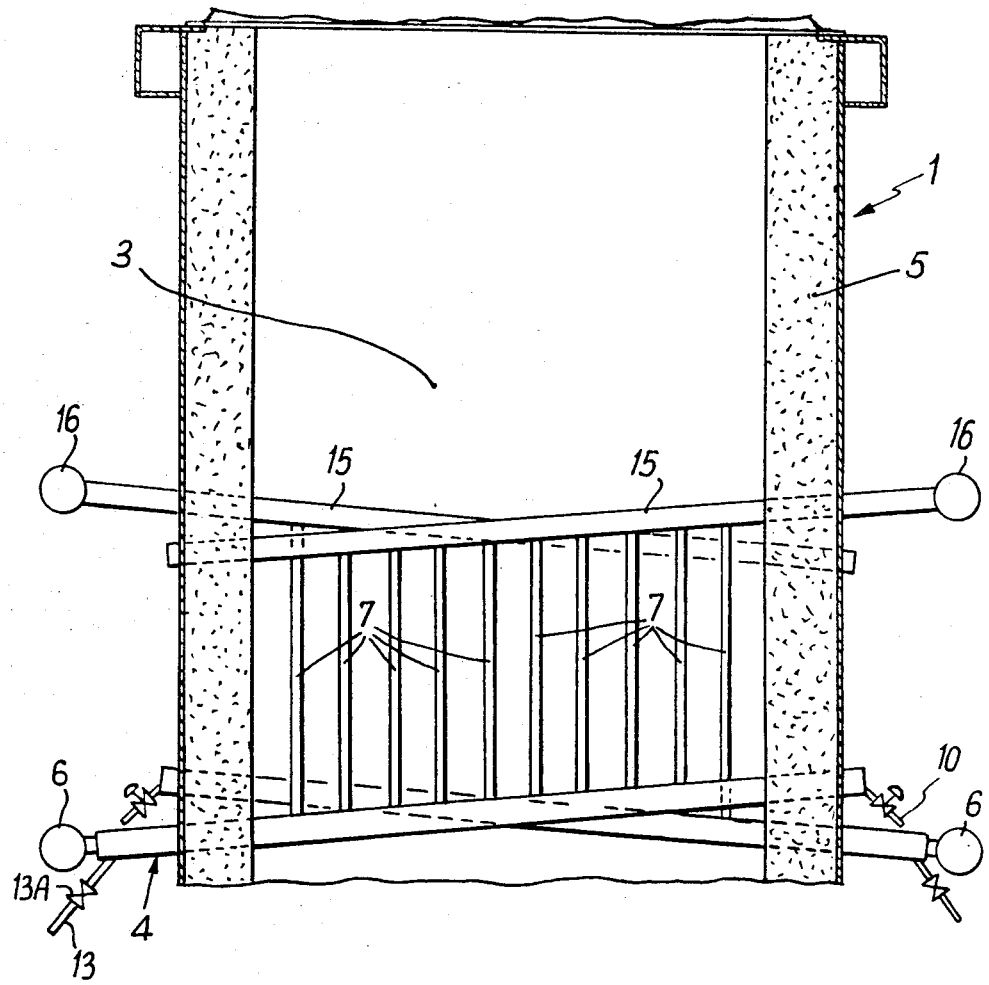
FIG. 4 is a sectional view through a vertical plane of the fluidisation chamber of a boiler equipped with two heat exchangers according to the invention.

FIG. 4 shows more clearly the interior of the furnace 3 of a boiler 1 in which two heat exchangers according to the invention, arranged in mutually opposite directions, are mounted. From each inclined lower header 4 there extend several vertical tubes 7 which lead to an upper header 15 which is inclined parallel to the lower header 4 to which it is connected. Each upper header 15 extends outside the boiler 1 where it is connected to a steam outlet pipe 16, and has a known design.

What we claim is:

1. A fluidised-bed apparatus with at least one heat exchanger having a lower header which is slightly inclined to the horizontal and is situated in the fluidised bed during operation, an upper header, and a plurality of upright tubes which extend between the lower header and the upper header, the lower header consisting of an internal duct, which is connected to a circuit for the heat-exchange fluid and from which the upright tubes extend, and an external duct, which is connected to an additional blowing gas supply line and is provided with blowing nozzles.

2. Apparatus according to claim 1, wherein the external duct is arranged coaxially in relation to the internal duct.

3. Apparatus according to claim 1, wherein the external duct is eccentric in relation to the internal duct and is connected to it in a tangential and intersecting manner to form an intermediate space therebetween which has a crescent-shaped cross-section.

4. Apparatus according to claim 3, wherein the intermediate space is widest below the bottom generatrix of the internal duct.

5. Apparatus according to claim 1, wherein the external duct of the lower header extends outside the walls of the apparatus and is connected at its upper end to the additional blowing gas supply line.

6. Apparatus according to claim 5, wherein the additional blowing gas supply line is connected to the lowest point, in a cross-sectional plane, of the upper end of the lower header.

7. Apparatus according to claim 1, wherein the external duct of the lower header extends outside the walls of the apparatus and is provided at its lower end with a bleed pipe having a bleed valve.

8. Apparatus according to claim 7, wherein the bleed pipe is connected to the lowest point, in a cross-sectional plane, of the lower end of the lower header.

9. Apparatus according to claim 1, wherein the blowing nozzles are located in the bottom of the external duct.

10. Apparatus according to claim 9, wherein the blowing nozzles are located on two generatrices each diverging at an angle of approximately 45° from the vertical.

* * * * *